US009488412B2

(12) United States Patent
Yu et al.

(10) Patent No.: US 9,488,412 B2
(45) Date of Patent: Nov. 8, 2016

(54) DRYING SYSTEM AND USE OF THE DRYING SYSTEM IN LAUNDRY DRYING DEVICE

(71) Applicant: Hangzhou Sanhua Research Institute Co., Ltd., Zhejiang (CN)

(72) Inventors: Zhijie Yu, Zhejiang (CN); Weiyi Zhang, Zhejiang (CN); Xinfeng Huang, Zhejiang (CN)

(73) Assignee: Hangzhou Sanhua Research Institute Co., Ltd., Zhejiang (CN)

( * ) Notice: Subject to any disclaimer, the term of this patent is extended or adjusted under 35 U.S.C. 154(b) by 49 days.

(21) Appl. No.: 14/712,122

(22) Filed: May 14, 2015

(65) Prior Publication Data

US 2015/0345866 A1 Dec. 3, 2015

(30) Foreign Application Priority Data

May 30, 2014 (CN) ..... 2014 1 0238684

(51) Int. Cl.

| | |
|---|---|
| ***D06F 58/12*** | (2006.01) |
| ***F26B 25/00*** | (2006.01) |
| ***D06F 58/20*** | (2006.01) |
| ***D06F 58/24*** | (2006.01) |

(52) U.S. Cl.

CPC ..... *F26B 25/005* (2013.01); *D06F 58/206* (2013.01); *D06F 58/24* (2013.01)

(58) Field of Classification Search

CPC ..... F26B 19/00; F26B 20/00; F26B 21/00; F26B 21/06; D06F 58/00; D06F 58/12; D06F 58/20

USPC ..... 34/601, 606, 610; 68/5 C, 5 R, 19, 20; 8/139, 149, 159

See application file for complete search history.

(56) References Cited

U.S. PATENT DOCUMENTS

| | | | | |
|---|---|---|---|---|
| 4,291,542 A * | 9/1981 | Sminge | B01D 53/265 62/156 |
| 4,603,489 A * | 8/1986 | Goldberg | D06F 58/02 34/605 |
| 4,987,952 A * | 1/1991 | Beal | F24F 3/1405 165/225 |
| 5,915,811 A * | 6/1999 | DeVore | F26B 3/286 34/212 |
| 7,073,273 B2 * | 7/2006 | Kim | D06F 58/20 34/595 |
| 7,624,514 B2 * | 12/2009 | Konabe | F26B 3/205 34/86 |
| 8,069,681 B1 * | 12/2011 | Cink | F24F 3/1405 62/176.1 |

(Continued)

FOREIGN PATENT DOCUMENTS

| | | | |
|---|---|---|---|
| BE | EP 2660383 A1 * | 11/2013 | D06F 58/04 |
| CN | 102286872 A | 12/2011 | |

(Continued)

*Primary Examiner* — Stephen M Gravini

(74) *Attorney, Agent, or Firm* — Boyle Friedrickton, S.C.

(57) ABSTRACT

A drying system and a laundry drying device are provided. The drying system includes a compressor, a draught fan, a casing, a throttling device, an evaporator and a condenser. The condenser and the evaporator are relatively fixedly arranged inside the casing, and the evaporator is obliquely arranged inside the casing; an inner space of the casing at least includes a first space at one side of the evaporator, a second space between the evaporator and the condenser, and a third space at another side of the condenser; a bottom portion of the casing is provided with a water reserving portion or a drainage hole, and the casing has a high point A at a portion where the condenser is arranged and a high point B at a portion where the evaporator is arranged, and the high point A is substantially same as the high point B.

19 Claims, 10 Drawing Sheets

(56) References Cited

U.S. PATENT DOCUMENTS 8,171,749 B2 * 5/2012 Lu ..... F25D 17/06 62/291
8,595,954 B2 * 12/2013 Lee ..... D06F 58/206 34/487
8,615,895 B2 * 12/2013 Shin ..... D06F 58/22 34/606
8,707,581 B2 * 4/2014 Quaroni ..... D06F 39/12 34/604
8,997,377 B2 * 4/2015 Kim ..... D06F 58/22 34/610
9,371,609 B2 * 6/2016 Anderson ..... D06F 58/28
2005/0066538 A1 * 3/2005 Goldberg ..... D06F 25/00 34/218
2013/0008049 A1 * 1/2013 Patil ..... F26B 21/086 34/469
2015/0257627 A1 * 9/2015 Park ..... A47L 15/483 34/72
2015/0345866 A1 * 12/2015 Yu ..... F26B 25/005 34/73

FOREIGN PATENT DOCUMENTS

IT WO 2011000760 A1 * 1/2011 ..... D06F 58/04
KR EP 2586904 A1 * 5/2013 ..... D06F 58/24
TR WO 2012146534 A2 * 11/2012 ..... D06F 58/20

* cited by examiner

DRYING SYSTEM AND USE OF THE DRYING SYSTEM IN LAUNDRY DRYING DEVICE

This application claims the benefit of priority to Chinese Patent Application No. 201410238684.9 titled "LAUNDRY DRYING DEVICE AND DRYING SYSTEM", filed with the Chinese State Intellectual Property Office on May 30, 2014, the entire disclosure of which is incorporated herein by reference.

FIELD

The present application relates to a drying system, and particularly to a use of the drying system in a laundry drying device.

BACKGROUND

With the continuous improvement of people's living standards, a laundry machine only having the washing function is already unable to meet people's requirements, and the laundry machine is required to have a drying function or to be equipped with a dryer to dry clothes, shoes, hats or other stuffs after these stuffs are washed. A washer-dryer or a laundry dryer generally includes the following drying modes: an electrical-heating water condensation type drying system, an electric-heating wind condensation type drying system, and a heat pump heating type drying system using evaporator condensation and condenser heating. Compared with the first two drying modes, the heat pump heating type drying system uses a heat pump for drying, which is relatively energy-saving, thus has a wide market application prospect.

A typical heat pump washer-dryer is disclosed in a Chinese Patent Application No. CN 102286872A published on Dec. 21, 2011, which includes a drum, a heat pump system, a drainage pump, and etc . . . The heat pump system includes a compressor, an evaporator and a condenser which are connected via pipelines. Components of the heat pump system including the compressor, the evaporator and the condenser are arranged at the bottom of the heat pump washer-dryer. Since the bottom of the heat pump washer-dryer generally has a large available space, it is a conventional design in the industry to arrange the heat pump system at the bottom of the heat pump washer-dryer. However, in this case, it is inconvenient to discharge water.

Therefore, a technical problem to be addressed urgently in the field is to design a drying system and a laundry drying device, which have a good energy efficiency and is convenient to discharge condensate water, under the circumstance of space being limited.

SUMMARY

A drying system is provided according to the present application, which facilitates discharging condensate water and has a high energy efficiency and a small volume.

The following technical solutions are provided according to the present application.

A drying system includes a compressor, a draught fan, a casing, a throttling device, an evaporator and a condenser; wherein the condenser and the evaporator are relatively fixedly arranged inside the casing, and the evaporator is obliquely arranged inside the casing; under the arrangement of the condenser and the evaporator, an inner space of the casing at least includes a first space at one side of the evaporator, a second space between the evaporator and the condenser, and a third space at another side of the condenser; a bottom portion of the casing is provided with a water reserving portion or a drainage hole configured to discharge condensate water, the water reserving portion or the drainage hole is arranged below or laterally below the evaporator, and the casing has a high point A at a portion where the condenser is arranged and a high point B at a portion where the evaporator is arranged, and the high point A is substantially same as the high point B.

The evaporator is a micro-channel heat exchanger and includes at least two headers, a plurality of flat tubes, and a plurality of fins, two ends of each flat tube are in communication with the headers respectively, and the fins are each arranged between adjacent flat tubes; at least one of the headers is located at a lower position and arranged horizontally, and a main body portion of the flat tube is obliquely arrange.

An evaporator accommodating portion of the casing is provided with a first supporting portion and a first limiting portion, and the header at the lower position is horizontally supported on the first supporting portion; the first supporting portion is provided with at least one circulating portion configured to allow the condensate water to flow to the water reserving portion or the drainage hole through the circulating portion, and an angle $\alpha$ formed between the evaporator and the horizontal plane satisfies the relationship: $10° \leq \alpha \leq 30°$.

The condenser is a multi-layer micro-channel heat exchanger having at least two layers, and is arranged inside the casing approximately uprightly, and the condenser includes at least two headers, a plurality of flat tubes, and a plurality of fins, two ends of each flat tube are in communication with the headers respectively, and the fins are each arranged between adjacent flat tubes; at least one header of the condenser is approximately uprightly arranged and a main body portion of the flat tube is approximately horizontally arranged, or at least one header of the condenser is approximately horizontally arranged and a main body portion of the flat tube is approximately uprightly arranged.

In the second space of the casing, an air guiding portion is provided close to the condenser, the air guiding portion is of a streamline design with a structure gradually narrowed in the direction from the evaporator to the condenser, and covers a finless area at two ends of the condenser; and the air guiding portion includes a vent at one end close to the condenser, and a width of the vent is adapted to a size of a finned area of the condenser.

The two headers of the condenser are approximately uprightly arranged, the main body portion of the flat tube is approximately horizontally arranged, and two ends of the condenser are a finless area; a transverse limiting portion configured to limit the position of the condenser transversely is provided in the casing, and the transverse limiting portion is configured to cover the finless area at two ends of the condenser in the width direction to reduce the quantity of air passing through the finless area; a stopper is provided in the second space of the casing at a position close to the condenser, the stopper is fixedly connected to the bottom portion of the casing, and two ends of the stopper are connected to the air guiding portion to form a waterproof structure; a portion, at one side of the stopper close to the evaporator, of the second space is higher than a portion of the casing where the water reserving portion or the drainage hole is arranged, and a backflow passage is provided between the stopper and the water reserving portion or the drainage hole.

The casing includes a base and a casing cover; the base includes a condenser accommodating portion configured to receive the condenser, and the condenser accommodating portion includes a supporting portion configured to support a side plate of the condenser, the stopper is arranged on the base, and a height of the stopper is higher than a height of the supporting portion; the casing cover includes a third flow guide portion, the third flow guide portion is arranged between the condenser and the evaporator, and in the height direction, the third flow guide portion is of a streamline structure gradually enlarged from the evaporator to the condenser.

The casing is of an approximately L shape, and the condenser and the evaporator are arranged in a transverse main body portion of the casing; the evaporator being obliquely arranged refers to that a lower end of the evaporator is arranged away from the condenser, and another higher end of the evaporator is arranged close to the condenser, the first space is located at one side of the evaporator away from the condenser, and the first space is in communication with an air inlet duct of the casing, or is in communication with the air inlet duct of the casing via the draught fan; and the water reserving portion or the drainage hole is arranged at a bottom portion of the second space between the condenser and the evaporator.

A blocking portion is provided on the casing at a position close to the evaporator and extends away from the evaporator; the blocking portion is arranged at a lower position close to the evaporator and is of an approximately plate structure, and a lower portion of the blocking portion and two end portions of the lower portion of the blocking portion are fixedly connected to the casing to form a waterproof structure.

Moreover, a use of a drying system in a laundry drying device is provided by the present application, wherein the laundry drying device includes a housing, a drying system and a drum, the drying system and the drum are arranged inside the housing, and the drying system is any one of the above-described drying systems. The condenser and the evaporator are arranged in a main body portion of the casing and arranged laterally above the drum; two ends of the casing are connected to the drum via ducts, the draught fan is connected between one end of the two ends of the casing and the drum; a filter device is provided in a duct in the casing or in a duct between one end of the two ends of the casing and the drum, the first space is in communication with an air inlet of the casing; and the third space is in communication with the drum via an air outlet duct.

In the present application, the evaporator of the heat pump is obliquely arranged inside the casing, and the condenser and evaporator are arranged above or laterally above the drum, thus the drying system can be arranged in an unoccupied position of the laundry drying device, and wider the circumstance of ensuing a same energy efficiency, the laundry drying device is small, or compared with a conventional electrical heating laundry drying device, the laundry drying device in the present application has an improved energy efficiency ratio in the drying process while having the approximately same volume. The drying system is close to the drum, thus there is no need to provide long air ducts to connect the drying system to the drum.

BRIEF DESCRIPTION OF THE DRAWINGS

Exemplary embodiments of the heat pump type laundry drying device are described as follows. The drawings are only for showing the embodiments and should not be regarded as limitation to embodiments of the present application, for example, fins of the heat exchanger are just partially shown instead of being entirely depicted.

DETAILED DESCRIPTION

Figure 1:
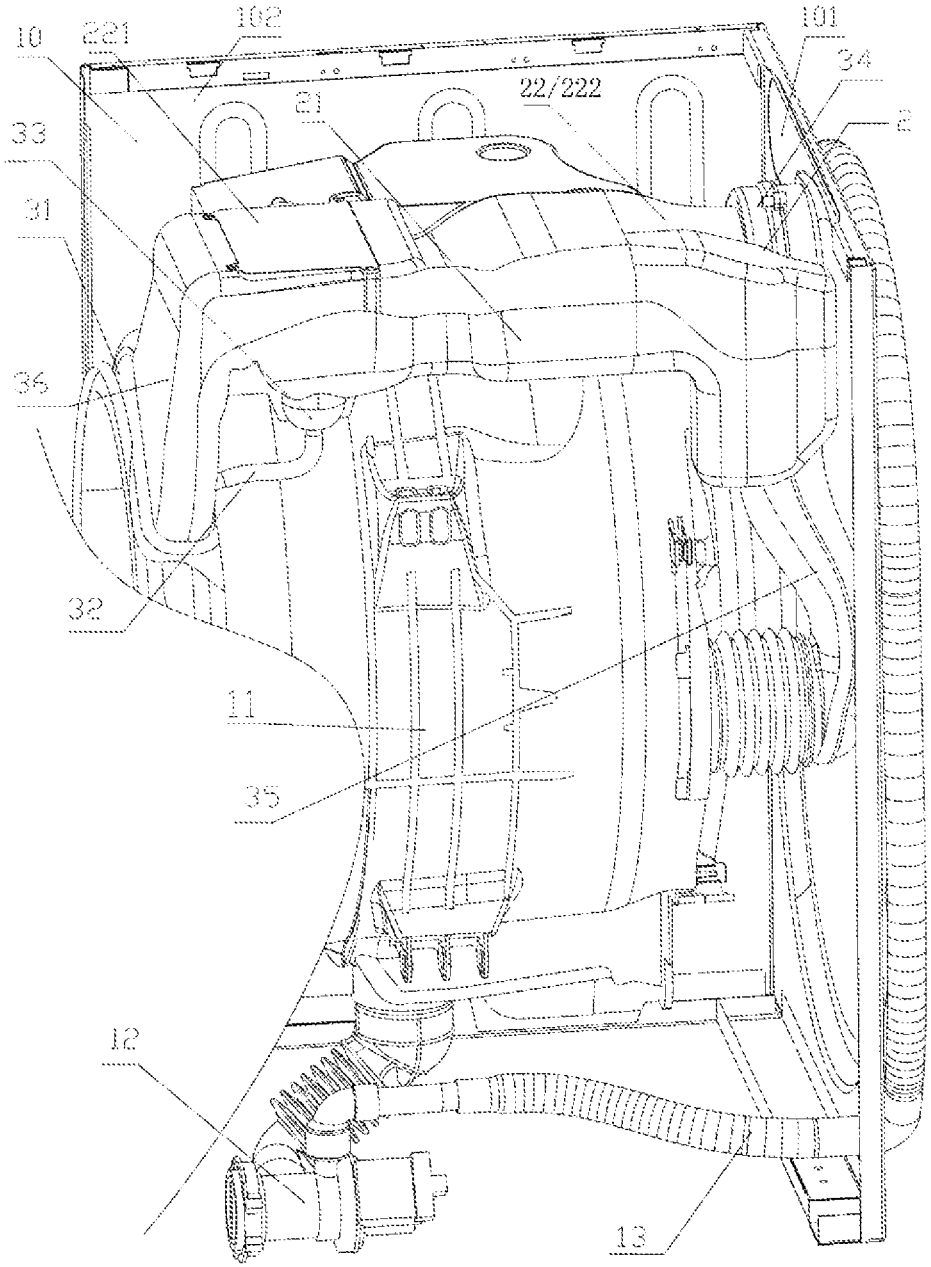
FIG. 1 is a partially perspective schematic view of an internal arrangement of a heat pump type laundry drying device with a part of a housing being removed.
Figure 4:
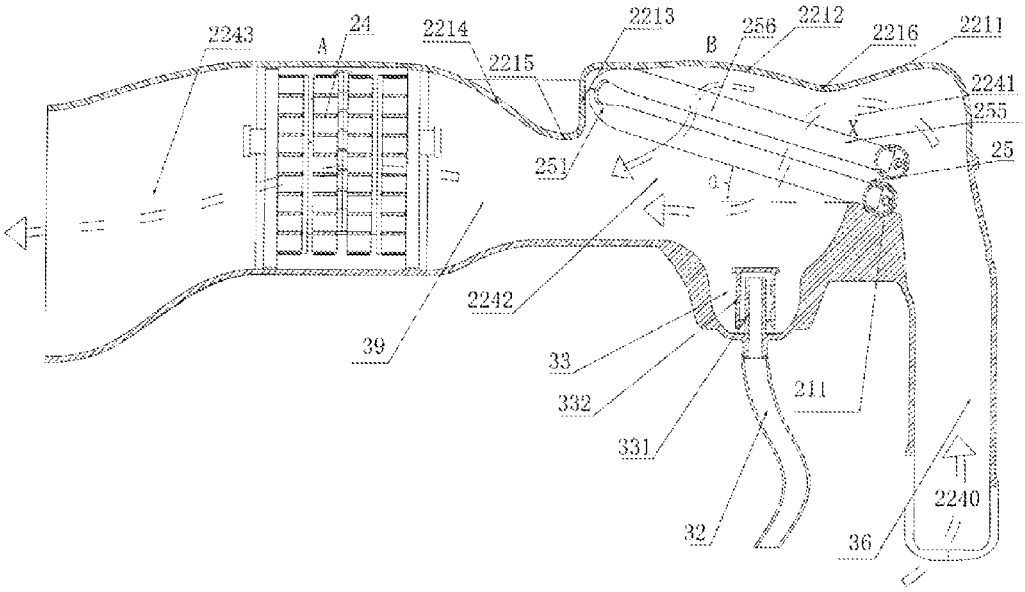
FIG. 4 is a partial sectional schematic view showing the heat pump type laundry drying device in FIG. 2 and mainly showing the arrangements of two heat exchangers and air ducts of the heat pump, wherein broken lines indicate the condition of airflow passing through the two heat exchangers.
Figure 5:
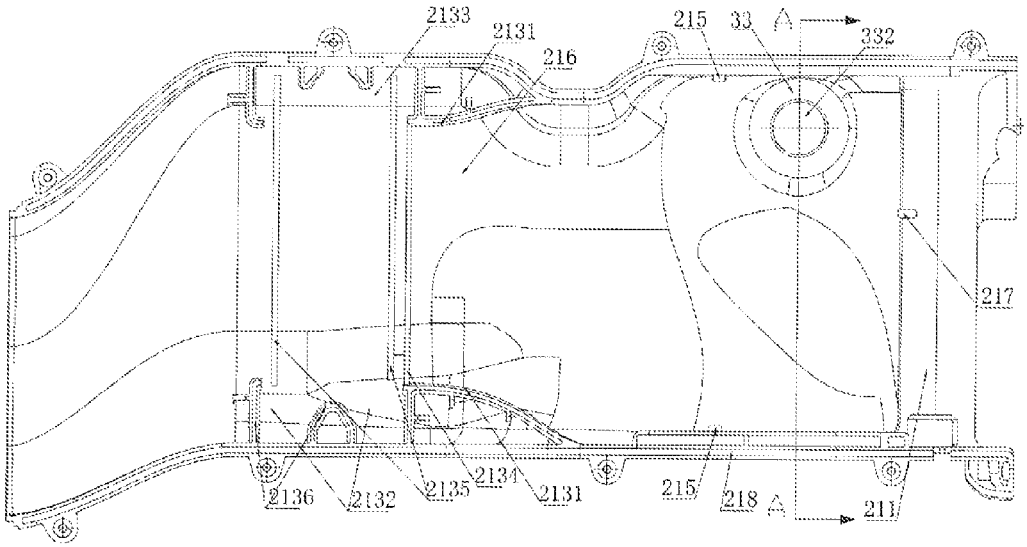
FIG. 5 is a schematic view showing a base member of a heat pump in another embodiment of the heat pump type laundry drying device.
Figure 6:
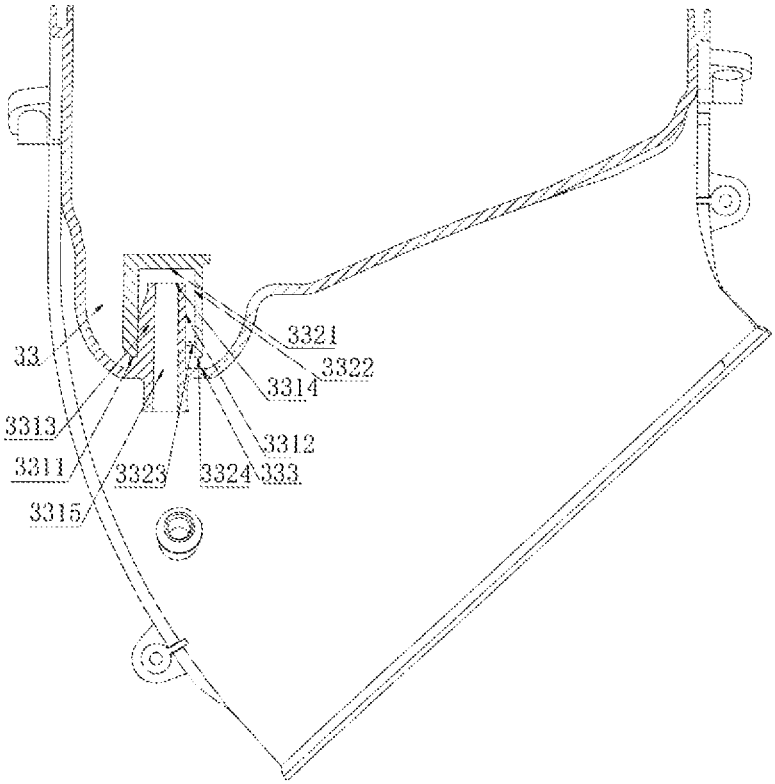
FIG. 6 is a partially schematic view of the base member in FIG. 5 which is taken along line A-A and rotated anticlockwise by 90 degrees.
Figure 7:
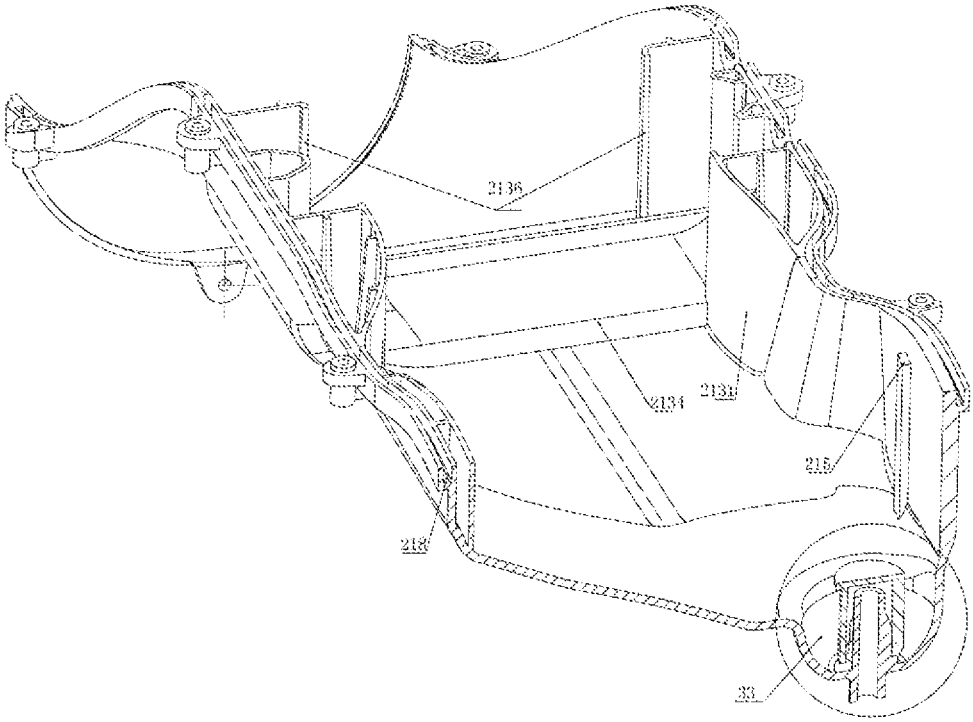
FIG. 7 is a partially perspective schematic view of the base member in FIG. 5 taken along a drainage mechanism.
Figure 8:
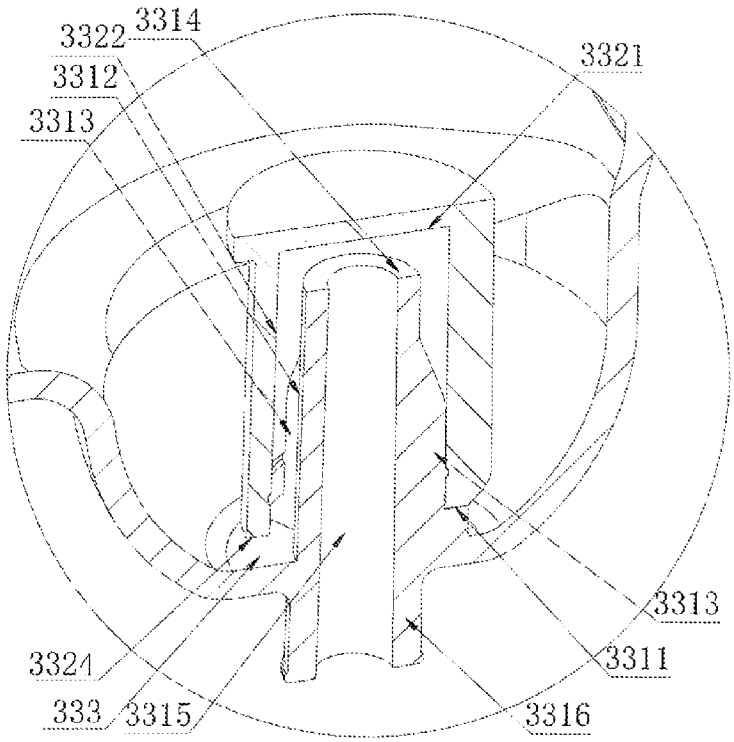
FIG. 8 is a partially enlarged schematic view of FIG. 7.
Figure 9:
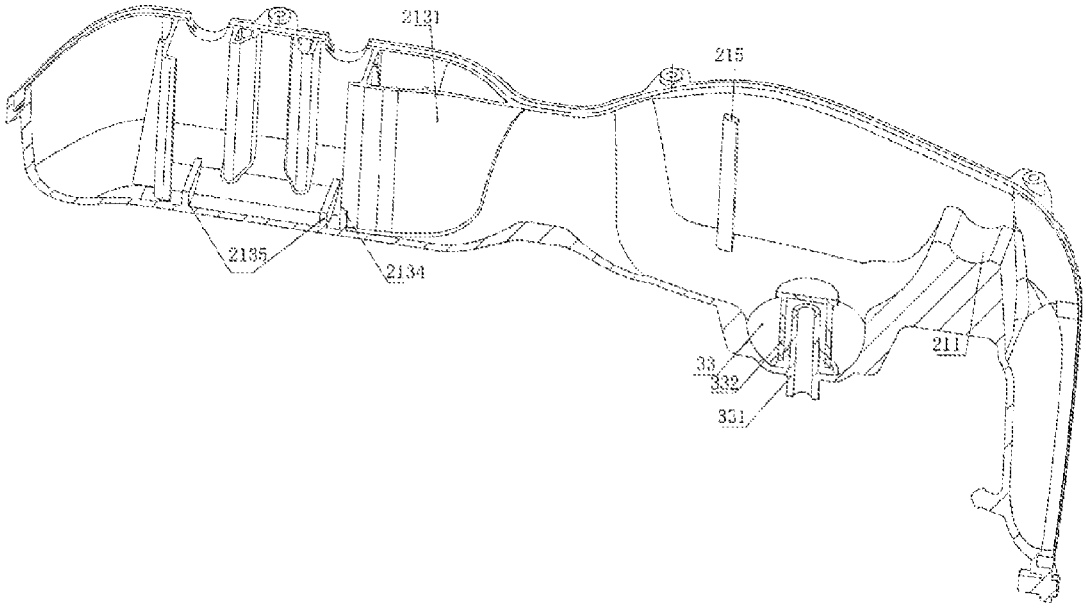
FIG. 9 is a partially perspective schematic view of the base member in FIG. 5 taken along the drainage mechanism in another direction.
Figure 10:
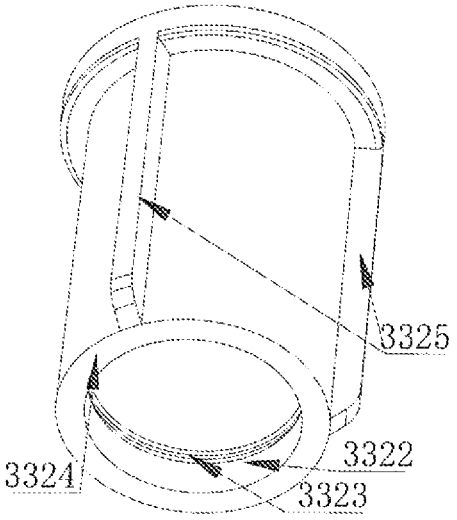
FIG. 10 is a perspective schematic view of a cover of the drainage mechanism according to an embodiment of the heat pump type laundry drying device.
Figure 11:
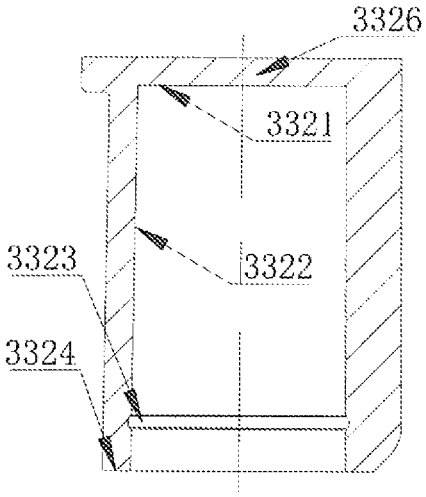
FIG. 11 is a sectional schematic view of FIG. 10.

A drum-type washer-dryer or a drum-type laundry dryer is described hereinafter as an example. Referring to FIGS. 1 and 4, a washer-dryer is provided according to an embodiment of the present application, which includes a washer-dryer housing 10, a drying system 2 and a drum 11 installed inside the washer-dryer housing 10, and further includes a drainage pump 12 configured to drain away water, and a main drainage pipe 13 connected to the drainage pump 12. The washer-dryer housing 10 includes a rear wall portion 101, a side wall portion 102, and a front end portion with a door. The drying system 2 includes a draught fan 34, a casing, and a heat pump with connection pipelines (not shown). The draught fan 34 includes a draught fan end cap 341, a draught fan vane wheel 340, and a draught fan base 342. The casing is substantially of an L shape, and includes a main body portion arranged substantially transversely and an extension portion. The extension portion acts as an air inlet duct 36 in this embodiment. An evaporator and a condenser are arranged inside the main body portion 39, the main body portion has a high point A outside a portion where the condenser is arranged and has a high point B outside a portion where the evaporator is arranged, and the high point A is substantially same as the high point B. The "substantially same" here refers to that a height difference is small, for example, the height difference is within 8 mm. An overall height of the casing can be reduced by configuring the two points A and B to have the substantial same heights, and the drying device can be arranged in the small space inside the casing. Two ends of the casing act as connection ports of an air duct, one end of the casing may be in communication with the drum 11 via the draught fan 34 and an air outlet duct 35, and the other end of the casing may be also in communication with the drum 11, for example the other end of the casing is in communication with the drum 11 via the air inlet duct 36, or via the air inlet duct 36 and a door seal 31 as shown in the figure. The draught fan 34 may also be arranged at one side of the casing corresponding to the air inlet duet 36, and in this case, the drying device can take in air from the drum 11, and dehumidify and heat the air through the heat pump and then deliver the dry and hot air back to the drum 11. Besides, a filter device may be provided in the ducts to filter fluffs in the air, to ensure the cleanliness of the process air.

In this embodiment, one end, relatively close to a front end surface, of the casing is connected to the drum 11 via the door seal 31, and an air filter device (not shown) may be arranged in the duct inside the casing, or in the duct between the casing and the door seal 31, or in the duct between the casing and the drum 11. Another end, relatively close to the rear wall portion 101, of the casing is connected to the drum 11 via the air outlet duct 35. The heat pump of the drying system 2 includes a compressor 20, a condenser 24, an evaporator 25, a throttling device (not shown), connection pipelines (not shown), and a refrigerant (not shown) configured to be filled in the heat pump. The condenser 24 and the evaporator 25 of the heat pump are arranged in the main body portion of the casing, and are arranged laterally above the drum 11, that is, are not arranged right above the middle of the drum 11 but are slightly inclined to the side wall portion 102, thus a space formed by the drum 11, a top wall portion (not shown) and the side wall portion 102 may be fully utilized. The heat pump herein refers to a device which can use the compressor to absorb heat in a low-temperature environment and release heat to a high-temperature environment. The throttling device may be a mechanical throttle, an electronic expansion valve, a thermal expansion valve, or a throttling solenoid valve and etc . . .

The casing in this embodiment includes a base member and a casing cover 22. The base member includes a base 21 and a cover 332 of the drainage mechanism. The casing cover 22 may be embodied as an injection molding part of an integrated structure, and may also be embodied as a separated structure, for example, the casing cover 22 in FIG. 1 includes a main body 222 and an upper cover 221 of a spray system. In the case that the separated structure is employed, the upper cover 221 of the spray system is arranged above the evaporator, and spraying can be performed at this position to ensure the cleanliness of the evaporator. The base 21 and the casing cover 22 may be embodied as plastic parts, for example, being formed by injection molding with thermoplastic material. The casing includes the air outlet duct 36, and the main body portion of the casing having a substantially elongated shape. The condenser 24 and the evaporator 25 are relatively fixedly arranged inside the main body portion of the casing. An inner space of the casing along the air duct at least may be separated, by the condenser 24 and the evaporator 25, into a first space 2241 before the evaporator, a second space 2242 after the evaporator and before the condenser, and a third space 2243 after the condenser, "the condenser 24 and the evaporator 25 are relatively fixedly arranged inside the casing" herein refers to that limiting structures are provided inside the casing to prevent the condenser 24 and the evaporator 25 from moving beyond a certain distance, instead of referring to that the condenser 24 and the evaporator 25 are completely immovable. The draught fan is arranged at one side of the casing relatively close to the third space 2243, that is being arranged closer to the condenser 24 compared with the evaporator 25. In this embodiment, the base 21 and the casing cover 22 are arranged in an up-down direction and fixed together by bolts, dips and etc . . . Notches may be provided at cooperation portions of the base 21 and the casing cover 22 and sealing strips are provided in the notches, to realize the relative sealing between the base 21 and the casing cover 22, thereby preventing the air leakage. Also, the base 21 and the casing cover 22 may firstly assembled and then are connected by plastic welding to prevent the air leakage. It should be understood by those skilled in the art, the two parts of the casing are not limited to the up-down arrangement, and may also be arranged in a left-right direction, and after the two parts are assembled, the cooperation portions of the two parts can be provided with sealing strips to realize sealing. In this case, the structures on the base and the structures on the casing cover are all arranged on the left and right casing components, such as a supporting portion, a guide portion, a flow guide portion, a limiting portion and etc.

The evaporator 25 and the condenser 24 are both embodied as a micro-channel heat exchanger which has a small volume and the heat exchange efficiency of which can meet the requirement, thus the evaporator 25 and the condenser 24 can be arranged laterally above the drum. The evaporator 25 includes at least two headers 252, flat tubes 254, and fins 253. Two ends of each flat tube 254 are in communication with the headers 252 respectively. The fins 253 are each arranged between adjacent flat tubes 254 and configured to perform heat exchange. In this embodiment, the evaporator 25 is embodied as a multi-layer heat exchanger, for example is a two-layer heat exchanger as shown in the figures, or may also be a multi-layer heat exchanger with more than three layers according to requirements. The two-layer heat exchanger as shown in the figures is described as an example hereinafter, the headers 252 are arranged at a lower position while a reversing portion 251 of the flat tube is arranged at a higher position, namely the evaporator 25 is obliquely arranged, that is the headers 252 of the evaporator are arranged substantially horizontally, and at least part of the flat tubes are arranged obliquely. The header being arranged horizontally herein refers to that an angle formed between the header 252 and the horizontal plane ranges from −3 to +3 degrees, which can increase the heat exchanging area and be adapted to the space requirement of this position, and specifically, an angle α formed between the evaporator and the horizontal plane satisfies the relationship: $10° \leq \alpha \leq 30°$; and more preferably, the angle α satisfies the relationship: $15° \leq \alpha \leq 24°$. If the angle α is too small, the heat exchanging efficiency of the evaporator is reduced at a side close to the reversing portions of the flat tubes. If the angle α is too large, an entire space is not enough in the case that the capacity of the evaporator is required to be large. If the height of the evaporator is constant, the capacity of the evaporator will be extremely small. The condenser 24 is also embodied as a multi-layer heat exchanger, such as a four-layer heat exchanger as shown in the figures, and may also be a multi-layer heat exchanger with more than two layers. The condenser 24 includes at least two headers 243, flat tubes 241, and fins 242. Two ends of each flat tube 241 are in communication with the two headers 243 respectively. Each fin 242 is arranged between adjacent flat tubes 241 and configured to perform heat exchange. The condenser 24 is arranged substantially upright, namely an angle formed between a main body of the condenser and the horizontal plane ranges from 85 to 95 degrees. In the case that the condenser is a micro-channel evaporator, a main body of the flat tube of the condenser 24 is arranged substantially horizontally, and the condenser 24 being arranged substantially upright refers to that an angle formed between the headers 243 of the condenser 24 and the horizontal plane ranges from 85 to 95 degrees. Two ends of the condenser 24 respectively form two finless areas, including a first finless area 245 at one end of the condenser 24 corresponding to the headers 243 and a second finless area 246 at one end of the condenser 24 corresponding to the reversing portions 244 of the flat tubes. A condenser accommodating portion is arranged inside the casing, and is embodied as a condenser accommodating portion 213 arranged on the base 21, and a condenser accommodating portion, which has a structure similar to the structure of the condenser accommodating portion on the base, is further arranged on the casing cover 22. In addition, for ensuring that the air passes through the finless areas at the two ends of the condenser as little as possible, air guiding portions are provided at two sides of the casing in the width direction along the airflow direction. As shown in the figures, an air guiding portion 2131 is arranged on the base 21 and an air guiding portion with the similar structure is arranged on the casing cover, and each of the air guiding portions is of a streamline design with a structure gradually narrowed in the direction from the evaporator to the condenser. A ventilation opening close to the condenser has a width adapted to the size of a finned area of the condenser, and in this way, the air arriving at the condenser can pass through the finned area as uniformly as possible to exchange heat. The finned area of the condenser herein refers to the finned area arranged between adjacent flat tubes, and does not include the fins between the side plates and respective flat tubes. A width W1, close to the condenser, of the ventilation opening of the air guiding portion is adapted to a width W2 of the finned area of the condenser, which refers to that the width difference (W1−W2) does not exceed ±2 mm. In addition, the casing further includes a transverse limiting portion 2136 which may prevent the air from flowing through the finless area and limit the position of the condenser transversely. Similarly, the casing cover may be accordingly provided with a transverse limiting portion, and in this case, even though the air guiding portion is not provided, the air passing through the finless area is relatively little. Thus due to the arrangement of the limiting wind shielding portion, the base of the casing and two end walls of the casing cover, the position of the condenser 24 is limited better. Besides, although the condenser and the evaporator in this embodiment are both of a single-path multi-layer structure, the condenser and the evaporator may also have a multi-path structure, such as a two-path structure, a three-path structure, or a four-path structure and etc . . .

In this embodiment, the headers 252 of the evaporator are arranged at a lower position, specifically are arranged at a first supporting portion 211 of the base 21. The first supporting portion 211 has a shape matching with the shape of the headers, for example, a cross section of the first supporting portion 211 is arc-shaped. A first limiting portion 215 is arranged on the base 21 to prevent the evaporator 25 from sliding downward. A water reserving portion 33 is arranged on the base 21 at a lower position. The water reserving portion 33 is arranged under the evaporator 25, thus condensate water may naturally flow to the water reserving portion 33 under the action of gravity, and a drainage pipe may be provided in the water reserving portion 33 to discharge water naturally. Moreover, a water drainage mechanism may be provided on the base 21 at a portion corresponding to the water reserving portion 33. The drainage mechanism includes a drainage duct 331 and a drainage mechanism cover 332. A protruding outer end of the drainage duct 331 may discharge the condensate water in the evaporator via a drainage pipe 32. The drainage pipe 32 may be connected to an outer drum of the drum 11 or one end of an inlet pipe of the drainage pump 12 to discharge water via the drainage pump 12, or may be directly connected to the main drainage pipe 13, namely the water is directly discharged without passing through the drainage pump 12, which may prevent cotton wools or other impurities carried by the clothes from accumulating in the drainage pump to block the drainage pump. When water accumulated in the water reserving portion 33 reaches a certain height, the accumulated water is discharged through the drainage duet 331, and an airless area is formed between the drainage duct 331 and the drainage mechanism cover 332, thus a pressure difference is generated between the water reserving portion 33 and the drainage pipe 32, to facilitate discharging the cotton wool and other impurities smoothly under the action of the pressure difference. The condensate water is generated gradually in the laundry drying process, thus the flow rate of the water is not large, and if there is no pressure difference, part of impurities and fluffs cannot flow out of the casing with the water and are accumulated inside the casing, and an abnormal taste may be caused after a long-term using. If the drainage mechanism in this embodiment is employed, there is no need to use a drainage pump for driving the drainage mechanism, and also part of the impurities and fluffs in the water reserving portion may be discharged under the action of the pressure difference. And also, before the drainage mechanism is triggered, the condensate water may flow into a portion between the drainage duct and the drainage mechanism cover 332, in this way, a water seal structure is formed, thereby avoiding air flowing between the interior of the casing and the outside to exchange heat. Of course, the water reserving portion may be arranged at other lower positions of the second space between the evaporator and the condenser; or instead of providing the water reserving portion, a drainage hole is directly arranged at a lower position of the second space between the evaporator and the condenser in the casing to discharge water. Besides, the arranging direction of the evaporator may be changed, for example, the headers of the evaporator may be arranged a lower position close to the condenser, to enable the evaporator to be arranged obliquely towards the upper right side, and in this case, the water reserving portion may be arranged at a lower position below the evaporator.

In addition, the first supporting portion 211 of the base 21 is provided with at least one circulating portion 217, thus when condensate water is generated inside the evaporator 25 and part of the condensate water is accumulated at the first supporting portion 211, the part of condensate water may flow out through the circulating portion 217 and flow into the water reserving portion 33 at a lower portion along a wall portion of the base, thereby avoiding this part of condensate water flowing into the drum.

The casing in this embodiment is further provided with a compressor accommodating portion 219, and includes at least one communicating hole 2190 configured to communicate the compressor accommodating portion 219 with the third space 2243 after the condenser in the air flowing direction, thereby facilitating transferring heat of the compressor to the dry air, and increasing the energy efficiency ratio. Besides, the compressor may also be fixed on the housing of the washer-dryer instead of being fixed inside the casing, and is connected to the condenser, the evaporator and other components via pipelines.

Figure 2:
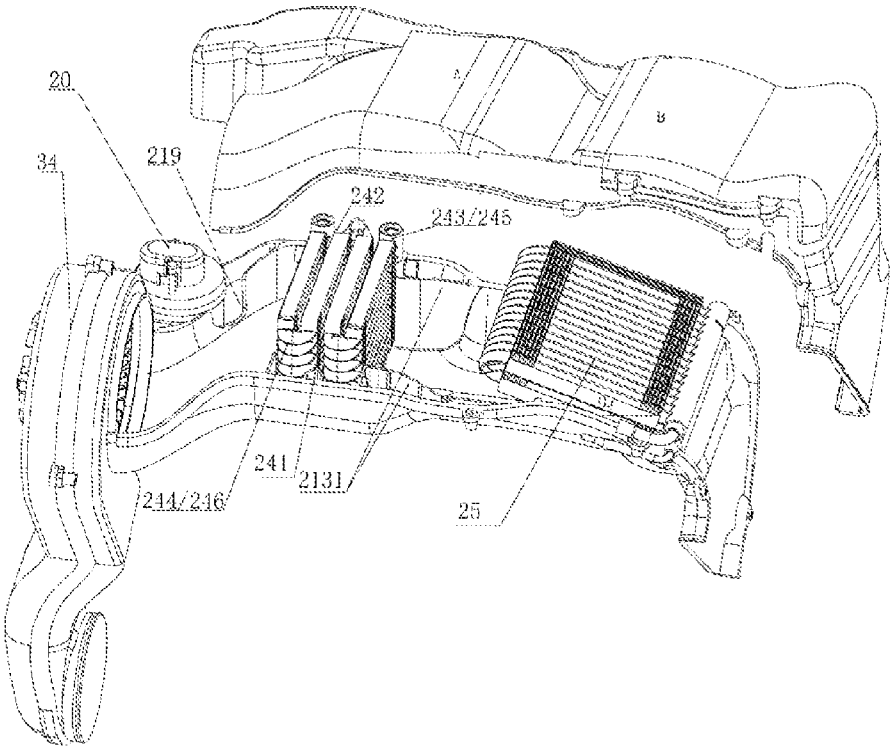
FIG. 2 is a schematic view showing the arrangement of several parts according to an embodiment of the heat pump type laundry drying device, wherein a throttling device and refrigerant connection pipelines between the parts are not shown.
Figure 3:
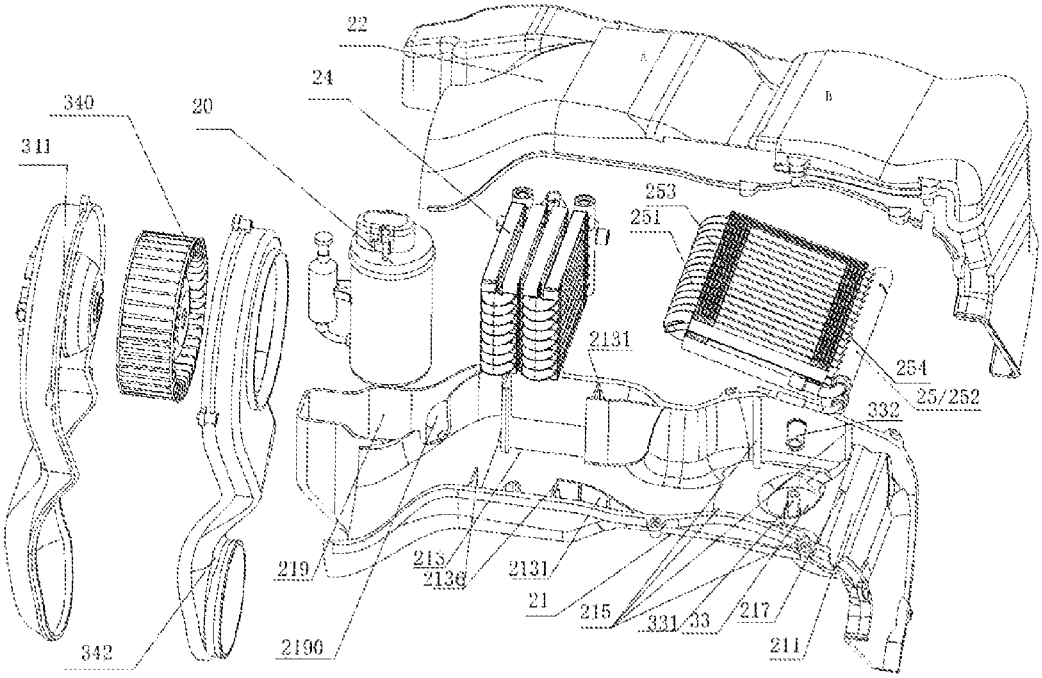
FIG. 3 is a perspective exploded view of FIG. 2.

A wall portion, above the evaporator 25, of the casing cover 22 may be a smooth and flat planar structure, that is, an inner wall portion of the casing cover 22 may be a plane. In addition, as shown in FIGS. 2 to 4, the casing cover 22 includes a first flow guide portion 2211, a second flow guide portion 2212, a blocking and limiting portion 2213, a third flow guide portion 2214 and an indentation portion 2215 which are arranged in the airflow direction. The existence of the indentation portion 2215 forms the blocking and limiting portion 2213 which limits the position of the evaporator 25 transversely and blocks the airflow passing through the reversing portions 251 of the flat tubes of the evaporator 25, thereby allowing the airflow to pass through the finned area of the evaporator 25 to improve the heat exchanging efficiency. A part of the first flow guide portion 2211 is arranged above the evaporator 25, the remaining part of the first flow guide portion 2211 is arranged above the evaporator 25 at a position inclined to the air inlet duct, and the second flow guide portion 2212 is arranged above the evaporator 25. The evaporator 25 may be divided into a first heat exchanging area 255 close to the headers 252, and a second heat exchanging area 256 close to the reversing portions 251 of the flat tubes. A portion, above the evaporator 25, of the casing cover 22 includes the first flow guide portion 2211, the second flow guide portion 2212, and a sunken transition portion 2216 between the first flow guide portion 2211 and the second flow guide portion 2212. The sunken transition portion 2216 allows a smooth transition between the first flow guide portion 2211 and the second flow guide portion 2212, thus, when air enters from an air inlet 2240 and passes through the air inlet duct 36, the air is veered after arriving at the first flow guide portion 2211, and at least part of the airflow is veered downward to pass through the first heat exchanging area 255 of the evaporator 25, and the rest of the airflow moves toward the second flow guide portion 2212 along the casing cover and then moves downward gradually to pass through the second heat exchanging area 256 of the evaporator, thus the airflow from the first space 2241 before the evaporator in the casing can uniformly pass through the evaporator 25 to reach the second space 2242 after the evaporator and before the condenser, thereby improving the heat exchanging efficiency. The indentation portion 2215 recessed inward in the height direction is formed due to the existence of the blocking and limiting portion 2213; the third flow guide portion 2214 is arranged on the casing cover between an accommodating portion for the evaporator 25 and the condenser accommodating portion 213, and is of a streamline structure in the height direction gradually enlarged from the indentation portion 2215 to the accommodating portion for the condenser 24, in this way, the airflow passing through the evaporator 25 is distributed uniformly. The casing is also provided with an air guiding portion 2131 in the width direction, and the air guiding portion 2131 is of a streamline structure gradually narrowed from the evaporator 25 to the accommodating portion for the condenser 24, thereby also facilitating distributing the airflow substantially uniformly. Structures related to the fluid flow, including the indentation portion, the first flow guide portion, the second flow guide portion, the third flow guide portion, the sunken transition portion and the air guiding portion, refer to the structures of the inner wall surface of the casing, and the outer wall surface of the casing may also have the same structure, in this way, the casing may have a relatively uniform wall thickness. Or, the outer wall of the casing may have a different structure, for example, the whole outer wall is a planar structure, and in this case, the wall thickness of the casing changes greatly. An ventilation opening allowing the airflow to pass through is provided at an end of the casing close to the condenser 24, and the height and width of the ventilation opening are adapted to the size of the finned area of the condenser, which may allow the air arriving at the condenser 24 to pass through the finned area as uniformly as possible to exchange heat. En this way, the air passing through the third space 2243 flows through the draught fan and is blew into the drum 11 via the air outlet duct 35, and wet air inside the drum 11 enters into the casing through the air inlet duct 36 due to the pressure difference, specifically, the wet air arrives at the first space 2241 before the evaporator via the air inlet 2240, then is dehumidified and cooled by the evaporator 25 and then arrives at the second space 2242, and then is heated by the condenser 24 and arrives at the third space 2243, and finally is blew into the drum 11 via the draught fan 34 to dry the clothes.

The air outlet duct 35 and the draught fan may be formed integrally as shown in FIG. 2, or the air outlet duct 35 may be fixedly connected to the draught fan. The positions of the air inlet 2240 and the air outlet may be switched. In addition, the above-described air guide structures are arranged on the casing cover, and in the case that the casing is formed by a left component and a right component, the flow guide portions are arranged on the two combined components and may still form air guide structures similar to the above structures after two components are assembled.

A base member according to another embodiment is described in detail hereinafter. Referring to FIGS. 5 to 11, a main difference between this embodiment and the above embodiment lies in that, in this embodiment, the condenser accommodating portion of the base is further provided with a supporting portion 2135 and a stopper 2134. The base member includes a base 21 and a drainage mechanism cover 332. The base 21 includes a supporting portion 211 configured to support the evaporator, and a first limiting portion 215, and further includes a circulating portion 217, and a water reserving portion 33 is arranged at a lower position of the base. The base 21 farther includes accommodating portions 2132, 2133 configured to receive two end portions of the condenser, a transverse limiting portion 2136 configured to limit the position of the condenser transversely, and a supporting portion 2135. In addition, the base further includes an air guiding portion 2131 and the stopper 2134 connected to the air guiding portion 2131. The height of the stopper 2134 is slightly higher than that the height of the supporting portion 2135, and a height difference between the stopper 2134 and the supporting portion 2135 is substantially equal to the width of a side plate of the condenser, and in this way, when the condenser is arranged on the supporting portion 2135, the stopper 2134 is substantially level with an upper plane of the side plate of the condenser, that is, level with the plane of the side plate that is in contact with the fins. Thus, when flowing to the condenser, the airflow almost does not pass through the side plate but passes through the finned area. Besides, in the case that there is moisture on the bottom wall of the base when the airflow flows to the condenser, the airflow may flow to the condenser with a part of the moisture, then the moisture cannot pass through the stopper 2134 due to the stopper 2134 and is retained at one side of the stopper 2134 close to the evaporator. And, the right side portion of the stopper 2134 is higher than the water reserving portion 33, and a backflow passage 216 is further provided between the stopper and the water reserving portion 33, thus this part of condensate water may flow back to the water reserving portion 33 via the backflow passage 216 to be discharged.

The drainage duct 331 in this embodiment is formed integrally with the base, and specifically the drainage duct 331 and the base are formed integrally by injection molding. The drainage duct 331 includes a drainage hole 3315 at the center and a connection portion 3316 configured to be connected to the drainage pipe, and is further provided with a longitudinal limiting portion 3311 configured to limit the position of the drainage mechanism cover 332 longitudinally, and a flange-shaped radial limiting portion 3313 configured to limit the position of the drainage mechanism cover 332 transversely. The number of the radial limiting portion 3313 and the number of the longitudinal limiting portion 3311 are both set as three, and may also be two or four or more, as long as the position of the drainage mechanism cover 332 is limited longitudinally and transversely. Moreover, the radial limiting portions and the longitudinal limiting portions may be provided on the drainage mechanism cover 332 instead of being provided on the drainage duct, for example, a protruding portion may be provided on the inner wall or the outer wall portion of the drainage mechanism cover to act as the radial limiting portion, and the protruding portion on the inner wall of the drainage mechanism cover may cooperate with the drainage duct to limit the position of the drainage mechanism cover longitudinally, or the protruding portion on the outer wall portion may cooperate with the side wall portion of the water reserving portion to limit the position of the drainage mechanism cover longitudinally. Thus the cooperation between the drainage duct and the drainage mechanism cover may also be realized. Due to the radial limiting portions 3313, a substantially uniform space is formed between a portion, except for the portion with the radial limiting portions 3313, of an outer wall surface 3312 of the drainage duct 331 and an inner wall surface 3322 of the drainage mechanism cover 332. The longitudinal limiting portions are embodied as protruding portions arranged on the outer wall of the drainage duct close to the bottom surface of the water reserving portion or are embodied as protruding portions integrally connected to the bottom surface of the water reserving portion as shown in the figures. In addition, the longitudinal limiting portions may also be arranged at the bottom of the water reserving portion, and embodied as upward protruding portions. Due to the longitudinal limiting portions 3311, a substantially uniform space is formed between a bottom 333, except for the portion with the longitudinal limiting portions 3311, of the water reserving portion and a bottom surface 3324 of the drainage mechanism cover 332. In this way, the water reserving portion 33 can be in communication with the drainage hole 3315 via the space between the bottom 333 of the water reserving portion and the bottom surface 3324 of the drainage mechanism cover 332, the space between the outer wall surface 3312 of the drainage duct 331 and the inner wall surface 3322 of the drainage mechanism cover 332, and a space between an upper end surface 3314 of the drainage duct 331 and an inner wall top surface 3321 of the drainage mechanism cover 332. Moreover, three ribs 3325 are provided on the outer wall of the drainage mechanism cover 332, and a groove portion 3323 is provided on the inner wall surface of the drainage mechanism cover 332.

Thus, when the washer-dryer or the laundry dryer is operated to dry the clothes, the refrigerant circulation and the air circulation of the heat pump are both started. In the refrigerant circulation system, the compressor 20 is started, high-pressure and high-temperature refrigerant comes out of the compressor 20, and firstly passes through the condenser 24 to exchange heat with airflow around the condenser to be cooled, then is throttled by the throttling device (not shown) to be depressurized and cooled, and then passes through the evaporator 25. The refrigerant is evaporated inside the evaporator 25 to absorb heat, that is, in the heat pump system, the evaporator 25 and the condenser 24 are respectively in a cooling state and a heating state. Meanwhile, the draught fan 34 of the air circulation system is started, and under the dynamic action of the draught fan 34, the process air with a high humidity comes out of the drain 11 and enters into the first space 2241 of the casing from the air inlet 2240 via the air inlet duct 36, and flows obliquely downward from an upper position to the second space 2242 through the evaporator 25, to exchange heat with the refrigerant inside the evaporator. Since the refrigerant in the evaporator has a low temperature, water vapor in the wet air may condense to condensate water when the wet air is in contact with the surface of the evaporator, thereby realizing the humidification effect. Since the air passes through the evaporator 25 obliquely downward from the upper position, the condensate water condensed on the surface of the evaporator 25 may drop to a lower position of the evaporator under the action of the airflow and gravity and be accumulated gradually into the water reserving portion 33 in a lower position of the casing, thus the condensate water is accumulated into the water reserving portion. An inner diameter of the drainage mechanism cover 332 is greater than an outer diameter of the drainage duct 331, and the top of the drainage mechanism cover 332 is higher than the drainage duct 331, thus during the drying process the condensate water may flow into the space between the drainage duct 331 and the drainage mechanism cover 332, and at the moment, the condensate water folios a water seal between the drainage duct 331 and the drainage mechanism cover 332, to isolate the inside of the casing from the outside of the casing. Under the action of the draught fan, the air pressure inside the casing is slightly lower than the air pressure outside the casing in the whole drying process, thus the water seal may prevent the air outside the casing from directly flowing into the casing without passing through the evaporator.

When the condensate water is accumulated to gradually fill the space between the drainage duct 331 and the drainage mechanism cover 332, until the condensate water reaches the upper end surface 3314 of the drainage duet 331 and reaches a height that can overcome the surface tension of the water, and at this time, the water may pass through the drainage hole 3315 to be discharged via the drainage pipe 32, which makes the space between the drainage duct 331 and the drainage mechanism cover 332 form a low pressure area, to generate a pressure difference between the water reserving portion 33 and the drainage pipe 32. Thus cotton wool and other impurities can be discharged smoothly under the action of the pressure difference, that is, the water in the water reserving portion may be substantially discharged. In this way, when the washer-dryer is used as a laundry dryer, there is even no need to arrange a drainage pump, and the water may be discharged only via the water drainage mechanism, and the cotton wool and other impurities in the water reserving portion may be discharged together with the water. Of course, the drainage pipe 32 may also be directly connected into the drum of the laundry drying device, and a main drainage pump is employed to discharge the water out of the machine. In addition, the drainage pipe 32 may also be connected to an inlet end or an outlet end of the main drainage pump.

In the embodiments described above, the supporting portion 211 supporting the headers 252 of the evaporator 25 is of a strip structure, and a cross section of the supporting portion 211 is of a substantially arc shape matching with the headers 252. The present application is not limited to this and the supporting portion 211 configured to support the headers 252 of the evaporator 25 may also be a supporting structure embodied as a plurality of points or blocks in a partial portion instead of the strip supporting structure. In addition, the periphery of the base 21 is further provided with a slot portion 218 configured to accommodate the sealing strip, thus when the base cooperates with the casing cover, the sealing strip can realize the seal between the base and the casing cover, to prevent the air leakage. The supporting portion 2135 and the stopper 2134 are formed integrally with the base, and specifically the supporting portion 2135, the stopper 2134 and the base are formed integrally by injection molding. In addition, the supporting portion 2135 and the stopper 2134 may be formed separately and then are fixed to the base by gluing or welding.

Figure 12:
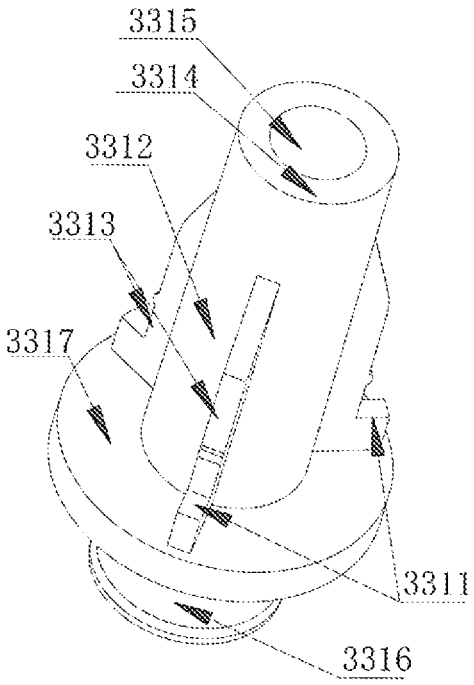
FIG. 12 is a perspective schematic view showing a drainage duct of the drainage mechanism according to a third embodiment of the heat pump type laundry drying device.
Figure 13:
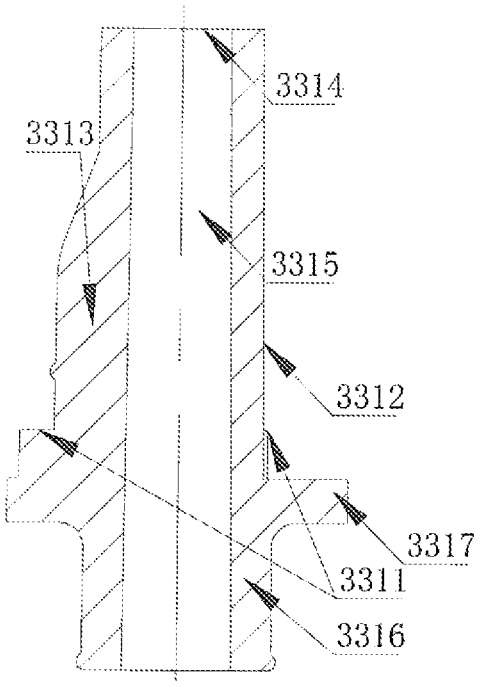
FIG. 13 is a sectional schematic view of FIG. 10.
Figure 14:
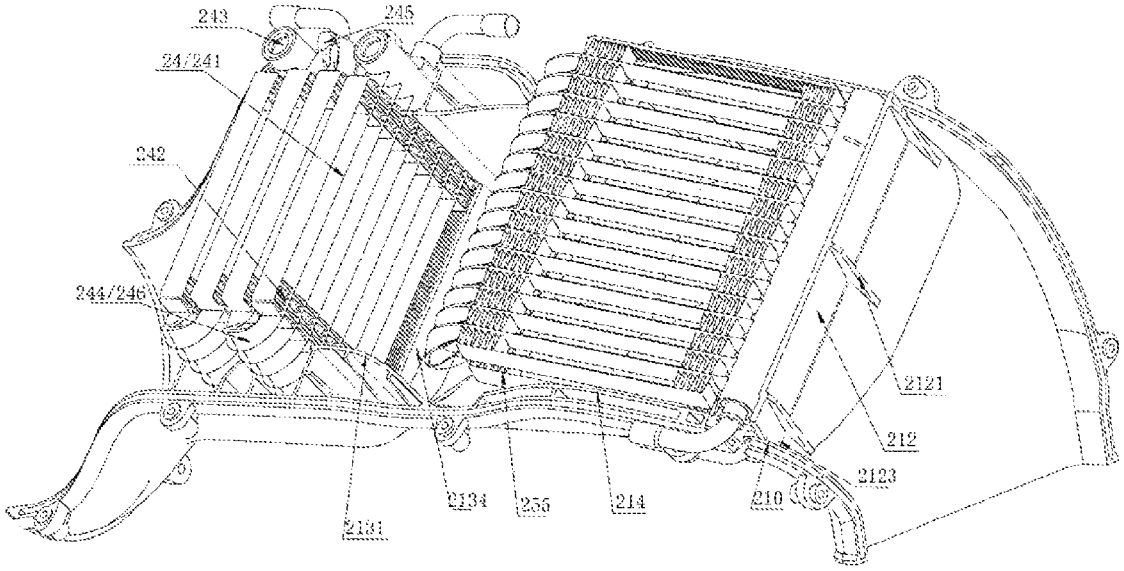
FIG. 14 is a perspective schematic view showing a condenser and an evaporator which are arranged on the base member according to a fourth embodiment of the heat pump type laundry drying device, wherein the throttling device and refrigerant connection pipelines between the parts are not shown.
Figure 15:
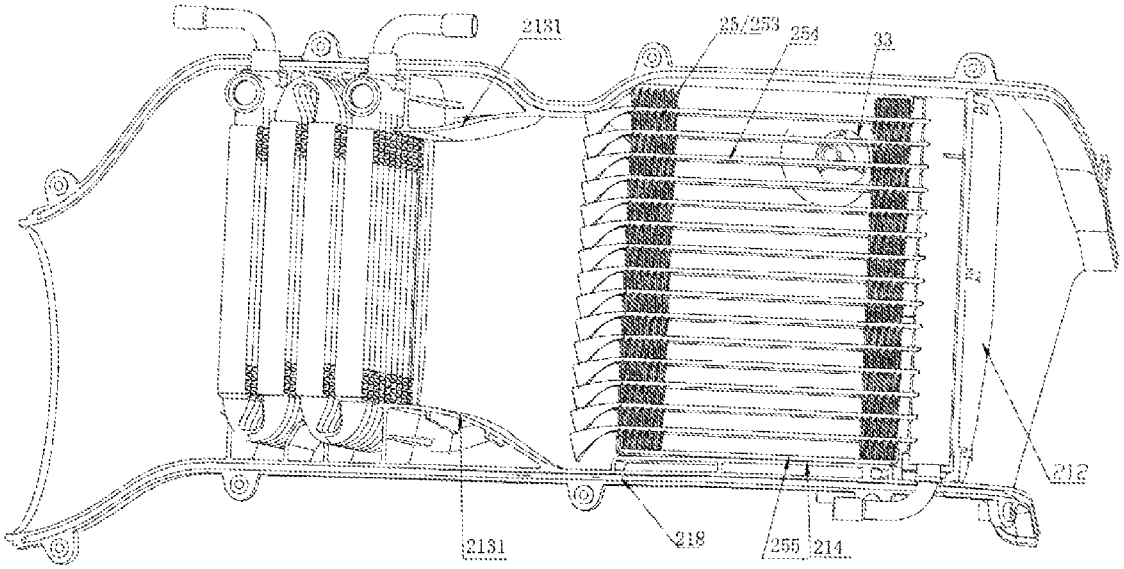
FIG. 15 is top schematic view of the heat pump type laundry drying device in FIG. 14, wherein the cover of the drainage mechanism is not shown.
Figure 16:
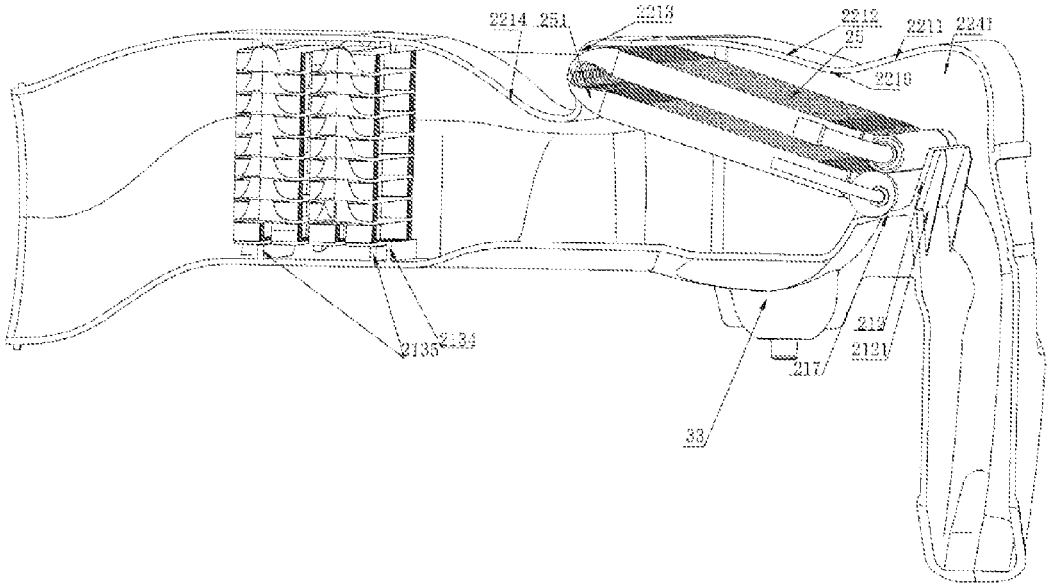
FIG. 16 is a perspective schematic view showing the arrangement of the heat pump type laundry drying device in FIG. 14 with the external being partially cut, and mainly showing the arrangement of the condenser and the evaporator.
Figure 17:
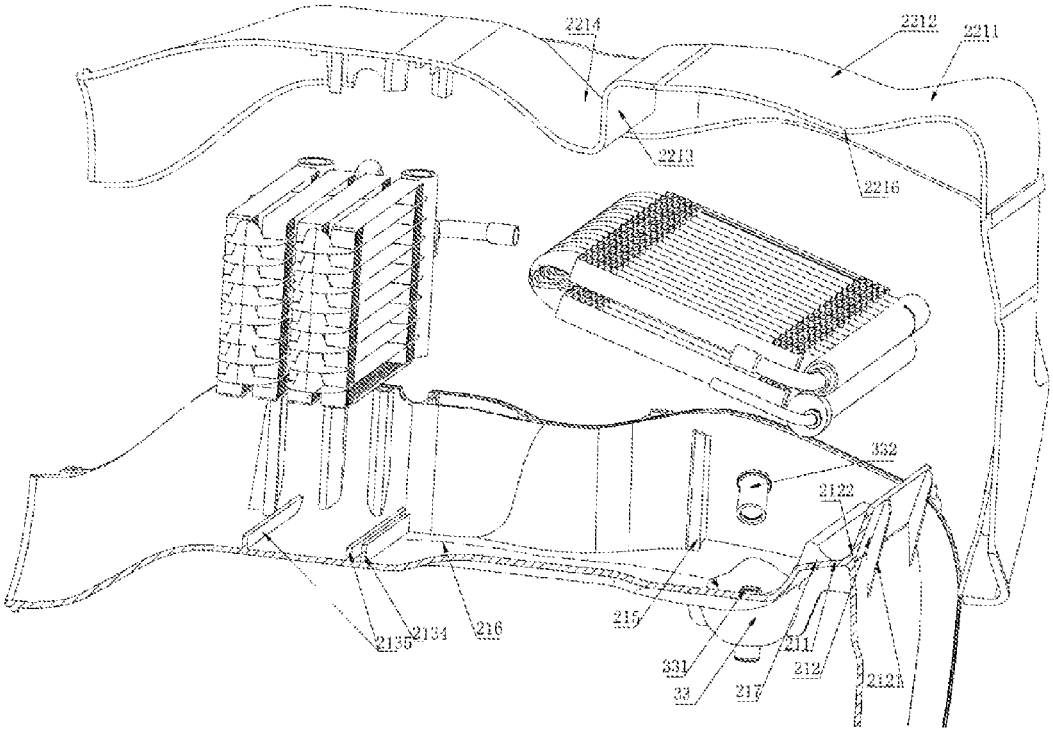
FIG. 17 is a perspective exploded schematic view of FIG. 16.

In the above embodiment, the drainage duct 331 and the base are integrally formed, however, the drainage duct 331 and the base may also be formed separately and then combined together as shown in FIGS. 12 and 13. The drainage duct 331 in this embodiment is machined separately, and then is fixedly connected to the base by gluing or plastic welding. Accordingly, a through-hole portion is provided in the water reserving portion of the base, and can be used to install the drainage duct. The through-hole portion of the base may be assembled with a cooperation portion 3317 of the drainage duct 331.

Another embodiment is described hereinafter, as shown in FIGS. 14 to 17. A main difference between this embodiment and the embodiment shown in FIGS. 5 to 9 lies in that, in this embodiment, the base is further provided with a blocking portion 212 configured to block the airflow, coming from the air inlet duct 36, from passing through the blocking portion, that is, the blocking portion 21 is configured to avoid the airflow directly passing through the evaporator 25 via the headers 252 of the evaporator 25, thus the situation that the airflow doesn't pass through the finned area of the evaporator to exchange heat can be avoided or alleviated, and the heat exchanging efficiency is improved. Meanwhile, the condensate water generated at the headers 252 of the evaporator 25 can be prevented from flowing back to the drum via the air inlet duct 36, and since the laundry drying efficiency is highly correlated with the amount of moisture in the hot air blew into the drum, the backflow of the condensate water can be avoided, to ensure that the air inside the drum 11 is relatively dry, and to enable the condensate water at the blocking portion to flow to the water reserving portion via the circulating portion 217 to be discharged. Moreover, for ensuring the strength of the blocking portion, several reinforcing ribs 2121 are provided. The blocking portion 212 and the reinforcing ribs 2121 may be formed integrally when the base is formed. The blocking portion 212 is arranged close to the first supporting portion 211, and is of a substantially plate shape. A lower portion 2122 of the blocking portion 212 is connected to the first supporting portion 211, two end portions 2123 on the lower portion of the blocking portion 212 are connected to two side portions 210 of the base at this portion to form a waterproof structure, to prevent the condensate water from flowing back to the drum or dropping to the air inlet duct 36 to flow back to the drum.

Figure 18:
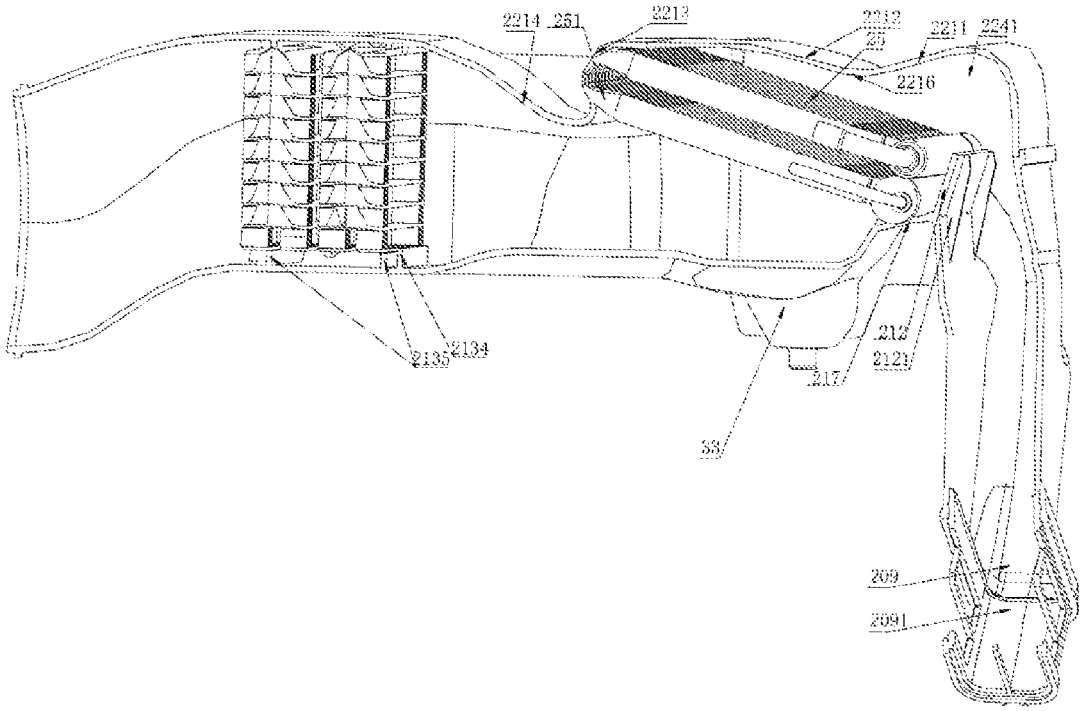
FIG. 18 is a perspective schematic view showing the arrangement of a fifth embodiment of the heat pump type laundry drying device with the external being partially cut.

Reference is made to FIG. 18. Unlike the above-described laundry drying device, in this embodiment, a filter device is arranged at the air inlet before the evaporator along the air duct. The filter device includes a filter bracket 209 fixed in a stuck form and a filter net 2091 fixed on the filter bracket 209. In addition, the filter device may also be arranged in the air outlet duct before the evaporator, or the filter device may be embodied as a filter net or a filter device of other structures, and the filter device may be arranged at any position between the evaporator and the air inlet of the casing, thus if the airflow from the drum carries soft flocks or other impurities in the clothes, the soft flocks or other impurities will be filtered by the filter device, thus the airflow arriving at the evaporator is clean, and it can prevent the soft flocks or other impurities from adhering to the surface of the evaporator to adversely affect the heat exchanging efficiency. The filter device in the solution shown in the figures is arranged at the position of the air inlet, which facilitates disassembling the filter device for cleaning.

It should be noted that, the above embodiments are only intended for describing the technical solutions of the present application, and should not be interpreted as limitation to the present application, such as the nouns of locality, front, rear, left, right, up, and down, should not be regarded as limitation to the orientation. Although the present application is described in detail in conjunction with the above embodiments, it should be understood that, for those skilled in the art, a few of combinations, modifications or equivalent substitutions may be made to the present application, and any technical solutions and the improvements thereof without departing from the spirit and scope of the present application are also deemed to fall into the scope of the present application defined by the claims.

The invention claimed is:

1. A drying system, comprising a compressor, a draught fan, a casing, a throttling device, an evaporator and a condenser; wherein the condenser and the evaporator are relatively fixedly arranged inside the casing, and the evaporator is obliquely arranged inside the casing; under the arrangement of the condenser and the evaporator, an inner space of the casing at least comprises a first space at one side of the evaporator, a second space between the evaporator and the condenser, and a third space at another side of the condenser; a bottom portion of the casing is provided with a water reserving portion or a drainage hole configured to discharge condensate water, the water reserving portion or the drainage hole is arranged below or laterally below the evaporator, and the casing has a high point A at a portion where the condenser is arranged and a high point B at a portion where the evaporator is arranged, and the high point A is substantially same as the high point B.

2. The drying system according to claim 1, wherein the evaporator is a micro-channel heat exchanger and comprises at least two headers, a plurality of flat tubes, and a plurality of fins, two ends of each flat tube are in communication with the headers respectively, and the fins are each arranged between adjacent flat tubes; at least one of the headers is located at a lower position and arranged horizontally, and a main body portion of the flat tube is obliquely arranged.

3. The drying system according to claim 2, wherein an evaporator accommodating portion of the casing is provided with a first supporting portion and a first limiting portion, and the header at the lower position is horizontally supported on the first supporting portion; the first supporting portion is provided with at least one circulating portion configured to allow the condensate water to flow to the water reserving portion or the drainage hole through the circulating portion, and an angle $\alpha$ formed between the evaporator and a horizontal plane satisfies the relationship: $10° \leq \alpha \leq 30°$.

4. The drying system according to claim 3, wherein the condenser is a multi-layer micro-channel heat exchanger having at least two layers, and is arranged inside the casing approximately uprightly, and the condenser comprises at least two headers, a plurality of flat tubes, and a plurality of fins, two ends of each flat tube are in communication with the headers respectively, and the fins are each arranged between adjacent flat tubes; at least one header of the condenser is approximately uprightly arranged and a main body portion of the flat tube is approximately horizontally arranged, or at least one header of the condenser is approximately horizontally arranged and a main body portion of the flat tube is approximately uprightly arranged.

5. The drying system according to claim 4, wherein in the second space of the casing, an air guiding portion is provided close to the condenser viewed from the top, the air guiding portion is of a streamline design with a structure gradually narrowed in the direction from the evaporator to the condenser, and covers a finless area at two ends of the condenser; and the air guiding portion comprises a vent at one end close to the condenser, and a width of the vent is adapted to a size of a finned area of the condenser.

6. The drying system according to claim 4, wherein the two headers of the condenser are approximately uprightly arranged, the main body portion of the flat tube is approximately horizontally arranged, and two ends of the condenser are a finless area; a transverse limiting portion configured to limit the position of the condenser transversely is provided in the casing, and the transverse limiting portion is configured to cover the finless area at two ends of the condenser in the width direction to reduce the quantity of air passing through the finless area; a stopper is provided in the second space of the casing at a position close to the condenser, the stopper is fixedly connected to the bottom portion of the casing, and two ends of the stopper are connected to the air guiding portion to form a waterproof structure; a portion, at one side of the stopper close to the evaporator, of the second space is higher than a portion of the casing where the water reserving portion or the drainage hole is arranged, and a backflow passage is provided between the stopper and the water reserving portion or the drainage hole.

7. The drying system according to claim 6, wherein the casing comprises a base and a casing cover; the base comprises a condenser accommodating portion configured to receive the condenser, and the condenser accommodating portion comprises a supporting portion configured to support a side plate of the condenser, the stopper is arranged on the base, and a height of the stopper is higher than a height of the supporting portion; the casing cover comprises a third flow guide portion, the third flow guide portion is arranged between the condenser and the evaporator, and in the height direction, the third flow guide portion is of a streamline structure gradually enlarged from the evaporator to the condenser.

8. The drying system according to claim 7, wherein the casing is of an approximately L shape, and the condenser and the evaporator are arranged in a transverse main body portion of the casing; the evaporator being obliquely arranged refers to that a lower end of the evaporator is arranged away from the condenser, and another higher end of the evaporator is arranged close to the condenser, the first space is located at one side of the evaporator away from the condenser, and the first space is in communication with an air inlet ducts of the casing, or is in communication with the air inlet ducts of the casing via the draught fan; and the water reserving portion or the drainage hole is arranged at a bottom portion of the second space between the condenser and the evaporator.

9. The drying system according to claim 8, wherein a blocking portion is provided on the casing at a position close to the evaporator and extends away from the evaporator; the blocking portion is arranged at a lower position close to the evaporator and is of an approximately plate structure, and a lower portion of the blocking portion and two end portions of the lower portion of the blocking portion are fixedly connected to the casing to form a waterproof structure.

10. The drying system according to claim 8, wherein, viewed in the height direction, an indentation portion is provided at a top wall of the casing between the condenser accommodating portion and the evaporator accommodating portion, the position of the indentation portion is lower than the condenser accommodating portion and the evaporator accommodating portion; the casing further comprises a first flow guide portion and a second flow guide portion which are both above the first space, the first flow guide portion is relatively away from the condenser accommodating portion, the second flow guide portion is relatively close to the indentation portion, and a sunken transition portion is provided between the first flow guide portion and the second flow guide portion; a third flow guide portion is arranged in the direction from the indentation portion to the condenser accommodating portion; the second flow guide portion and the sunken transition portion are arranged above the evaporator, the sunken transition portion is of a smooth transition structure configured to allow a smooth transit between the first flow guide portion and the second flow guide portion; and the third flow guide portion is of a streamline structure in the height direction gradually enlarged in the direction from the indentation portion to the condenser accommodating portion.

11. The drying system according to claim 10, wherein the casing further comprises a blocking and limiting portion, the blocking and limiting portion is arranged at a higher end of the evaporator, and is configured to transversely limit the position of the evaporator and block or reduce the air passing through the higher end of the evaporator; and a distance between the second flow guide portion and the evaporator is less than a distance between the first flow guide portion and the evaporator.

12. The drying system according to claim 1, wherein the condenser is a multi-layer micro-channel heat exchanger having at least two layers, and is arranged inside the casing approximately uprightly, and the condenser comprises at least two headers, a plurality of flat tubes, and a plurality of fins, two ends of each flat tube are in communication with the headers respectively, and the fins are each arranged between adjacent flat tubes; at least one header of the condenser is approximately uprightly arranged and a main body portion of the flat tube is approximately horizontally arranged, or at least one header of the condenser is approximately horizontally arranged and a main body portion of the flat tube is approximately uprightly arranged.

13. The drying system according to claim 2, wherein the condenser is a multi-layer micro-channel heat exchanger having at least two layers, and is arranged inside the casing approximately uprightly, and the condenser comprises at least two headers, a plurality of flat tubes, and a plurality of fins, two ends of each flat tube are in communication with the headers respectively, and the fins are each arranged between adjacent flat tubes; at least one header of the condenser is approximately uprightly arranged and a main body portion of the flat tube is approximately horizontally arranged, or at least one header of the condenser is approximately horizontally arranged and a main body portion of the flat tube is approximately uprightly arranged.

14. The drying system according to claim 12, wherein in the second space of the casing, an air guiding portion is provided close to the condenser viewed from the top, the air guiding portion is of a streamline design with a structure gradually narrowed in the direction from the evaporator to the condenser, and covers a finless area at two ends of the condenser; and the air guiding portion comprises a vent at one end close to the condenser, and a width of the vent is adapted to a size of a finned area of the condenser.

15. The drying, system according to claim 1, wherein the casing is of an approximately L shape, and the condenser and the evaporator are arranged in a transverse main body portion of the casing; the evaporator being obliquely arranged refers to that a lower end of the evaporator is arranged away from the condenser, and another higher end of the evaporator is arranged close to the condenser, the first space is located at one side of the evaporator away from the condenser, and the first space is in communication with an air inlet ducts of the casing, or is in communication with the air inlet ducts of the casing via the draught fan; and the water reserving portion or the drainage hole is arranged at a bottom portion of the second space between the condenser and the evaporator.

16. The drying system according to claim 2, wherein the casing is of an approximately L shape, and the condenser and the evaporator are arranged in a transverse main body portion of the casing; the evaporator being obliquely arranged refers to that a lower end of the evaporator is arranged away from the condenser, and another higher end of the evaporator is arranged close to the condenser, the first space is located at one side of the evaporator away from the condenser, and the first space is in communication with an air inlet ducts of the casing, or is in communication with the air inlet ducts of the casing via the draught fan; and the water reserving portion or the drainage hole is arranged at a bottom portion of the second space between the condenser and the evaporator.

17. The drying system according to claim 12, wherein the casing is of an approximately L shape, and the condenser and the evaporator are arranged in a transverse main body portion of the casing; the evaporator being obliquely arranged refers to that a lower end of the evaporator is arranged away from the condenser, and another higher end of the evaporator is arranged close to the condenser; the first space is located at one side of the evaporator away from the condenser, and the first space is in communication with an air inlet ducts of the casing, or is in communication with the air inlet ducts of the casing via the draught fan; and the water reserving portion or the drainage hole is arranged at a bottom portion of the second space between the condenser and the evaporator.

18. The drying system according to claim 13, wherein the casing is of an approximately L shape, and the condenser and the evaporator are arranged in a transverse main body portion of the casing; the evaporator being obliquely arranged refers to that a lower end of the evaporator is arranged away from the condenser; and another higher end of the evaporator is arranged close to the condenser, the first space is located at one side of the evaporator away from the condenser; and the first space is in communication with an air inlet ducts of the casing, or is in communication with the air inlet ducts of the casing via the draught fan; and the water reserving portion or the drainage hole is arranged at a bottom portion of the second space between the condenser and the evaporator.

19. A use of a drying system in a laundry drying device, wherein the laundry drying device comprises a housing, a drying system and a drum, the drying system and the drum are arranged inside the housing, the drying system comprises a compressor, a draught fan, a casing, a throttling device, an evaporator and a condenser; the condenser and the evaporator are arranged in a main body portion of the casing and arranged laterally above the drum; two ends of the casing are connected to the drum via ducts, the draught fan is connected between one end of the two ends of the casing and the drum;

wherein the condenser and the evaporator are relatively fixedly arranged inside the casing, and the evaporator is obliquely arranged inside the casing; under the arrangement of the condenser and the evaporator, an inner space of the casing at least comprises a first space at one side of the evaporator, a second space between the evaporator and the condenser, and a third space at another side of the condenser; a bottom portion of the casing is provided with a water reserving portion or a drainage hole configured to discharge condensate water, the water reserving portion or the drainage hole is arranged below or laterally below the evaporator, and the casing has a high point A at a portion where the condenser is arranged and a high point B at a portion where the evaporator is arranged, and the high point A is substantially same as the high point B; and the first space is in communication with the drum via an air inlet of the casing; the third space is in communication with the drum via an air outlet duct; and the laundry drying device is provided with a filter device between the evaporator and the air inlet of the casing.

* * * * *